United States Patent [19]

Saringer

[11] Patent Number: 4,637,379

[45] Date of Patent: Jan. 20, 1987

[54] DEVICE FOR IMPARTING CONTINUOUS PASSIVE MOTION TO LEG JOINTS

[75] Inventor: John H. Saringer, Toronto, Canada

[73] Assignee: Toronto Medical Corporation, Scarborough, Canada

[21] Appl. No.: 678,334

[22] Filed: Dec. 5, 1984

[51] Int. Cl.[4] ..... A61H 1/02; A61H 1/00

[52] U.S. Cl. ..... 128/25 R; 128/25 B

[58] Field of Search ..... 128/25 R, 25 B, 24 R, 128/48–51, 363; 272/DIG. 5; 324/207, 208; 33/141 R, 141 E, 142

[56] References Cited

U.S. PATENT DOCUMENTS

| | | | |
|---|---|---|---|
| 430,808 | 6/1890 | Naish | 128/25 R |
| 2,772,881 | 11/1956 | Fundom | 128/25 R |
| 3,568,666 | 3/1971 | Dunn | 128/25 R |
| 4,474,176 | 10/1984 | Farris et al. | 128/25 B |
| 4,492,222 | 1/1985 | Hajianpour | 128/25 B X |
| 4,549,534 | 10/1985 | Zagorski et al. | 128/25 R |

FOREIGN PATENT DOCUMENTS

| | | | |
|---|---|---|---|
| 3037619 | 5/1982 | Fed. Rep. of Germany | 128/25 R |
| 2468360 | 11/1979 | France | 128/25 R |
| 0766597 | 11/1978 | U.S.S.R. | 128/25 B |

*Primary Examiner*—Robert A. Hafer
*Assistant Examiner*—Kathleen J. D'Arrigo
*Attorney, Agent, or Firm*—Bachman & LaPointe

[57] ABSTRACT

An apparatus having an elongated base from the proximal end of which a reclining patient's leg is extended to an elevated connection of the foot with a foot rest. Mechanism is provided for moving the foot rest so that the hip and knee may be mobilized to the exclusion of the ankle or vice-versa, by applying forces similar to those applied manually by a physiotherapist. This mechanism translates the longitudinal reciprocal stroke of a motor driven carriage into a combination longitudinal and arcuate motion of the foot rest. The foot rest is mounted on the upper end of an actuating arm whose lower end has a pivotal connection with a carriage movable along the base, in linear strokes, toward and from the proximal end. A control beam has a pivotal connection to the upper end of the arm and is provided with a proximally extending frame for connection to the base to hold the beam in a position spaced from the proximal end with the arm held for pivotal movement relative to the upper end of the beam whereby the ankle only is mobilized with the knee and hip joints immobile. A catch mechanism is provided for locking the beam against pivotal movement relative to the arm whereby with the supporting frame free of the base and adjacent the leg, the patient's hip and knee joints are mobilized, with the ankle joint immobile. A reversible motor moves the carriage back and forth in linear strokes. A potentiometer measures the angular position of the actuating arm and is connected to the motor control whereby the length of the strokes is governed by setting limits on the angular movement of the actuating arm, regardless of the position of the carriage on the base. Mounting legs extend from the base, to mount the machine from fixed objects, through terminal clamps of unique construction.

14 Claims, 16 Drawing Figures

DEVICE FOR IMPARTING CONTINUOUS PASSIVE MOTION TO LEG JOINTS

BACKGROUND OF THE INVENTION

1. Field of the Invention

This invention relates to a method and apparatus for imparting continuous passive motion to a human joint.

2. Description of the Prior Art

"Continuous Passive Motion" (CPM) is the concept—both biological and clinical—of applying slow, rhythmic and continuous movement to joints immediately following joint injury or surgery. This concept is described, more fully, in the brochure "What is Continuous Passive Motion?" published by Toronto Medical Corp., Scarborough, Canada, incorporated herein by reference.

An apparatus for imparting continuous passive motion to joints is disclosed in U.S. patent application Ser. No. 362,896, filed Mar. 29, 1982, now U.S. Pat. No. 4,487,199, Dec. 11, 1984. Specific embodiments of that apparatus, originally developed for pediatric and sports medicine, have been put into commercial practice and are ideal under certain circumstances.

This earlier apparatus has some shortcomings, particularly as applied to heavier patients and older patients. Insufficient support is provided for the leg, the load on the foot is too great and there was no lifting motion for the knee.

An aim of the present invention is to provide an apparatus which avoids the shortcomings of the earlier apparatus and provides certain positive advantages as will be described, particularly for mobilizing the hip, knee and ankle joints.

STATEMENT OF THE INVENTION

Having regard to the foregoing, a preferred apparatus, according to the invention, is constructed as follows. It includes an elongated base having a distal end and a proximal end from which a reclining patient's leg is extended to an elevated connection of the foot with a foot rest. Mechanism is provided for moving the foot rest so that, in one mode, the hip and knee may be mobilized to the exclusion of the ankle or in another mode, only the ankle may be mobilized, by applying forces similar to those applied manually by a physiotherapist. This mechanism translates the longitudinal reciprocal stroke of a motor driven carriage into a combination longitudinal and arcuate motion of the foot rest. To this end, the foot rest has a lower pivotal connection to travelling means movable relative to the base, forming a linkage with the ankle, knee and hip joints when the mechanism is in one mode which is inoperative in one mode, but operative in the other mode, and in which there is an upper pivotal connection to spacing means for retaining the foot rest a given distance from the proximal end. In one embodiment of the invention, the spacing means are made up of a spacer frame which has a connection, at one end, to the foot rest and, at the other end, is connectable to the proximal end of the base. Motor means is provided for imparting reciprocal linear movement to the travelling means whereby, when the spacing means is operative, the foot rest pivots about the upper pivotal connection to mobilize the ankle. When the spacing means is inoperative, the foot rest pivots about the lower pivotal connection to mobilize the hip and knee joints. Control means is provided for controlling the motor means to reverse the stroke at given terminal angles of the foot rest to the linear path of travel In a preferred construction, the foot rest is mounted on the upper end of an actuating arm whose lower end has a lower pivotal connection with a carriage movable along the base, in linear strokes, toward and from the proximal end. Spacing means, as referred to above, includes a control beam connection through the upper pivotal connection to the upper end of the arm and is provided with a proximally extending frame for connection to the base to hold the beam in a position spaced from the proximal end. When the beam is in this position, the arm is held for pivotal movement relative to it, about the upper pivotal connection and the foot rest pivots about the upper pivotal connection, which is aligned with the ankle joint. Thus, the ankle only is mobilized, with the knee and hip joints immobile. Catch means is provided for locking the beam against movement relative to the arm whereby, with the supporting frame free of the base, the movement of the arm mobilizes the patient's hip and knee joints, with the ankle joint immobile. There is a reversible motor for moving the carriage back and forth in linear strokes. Means is connected to the motor control for measuring the angular position of the actuating arm, whereby the length of the stroke is set by limits imposed on the angular movement of the actuating arm, independently of the position of the carriage along the base. In a practical construction there are companion actuating arms, one at each side of the base and a spacing beam pivotally related to each supporting arm. In this case, the spacing and supporting frame has a rod extending proximally, at each side of the base, and a crossbar at the proximal end for engagement with the base in one setting and a sling, towards the proximal end, for supporting the leg below the knee, in the other position.

Preferably, the base is provided at each end with connecting posts for receiving adjustable supporting arms for adjusting the elevation and angle of the base relative to the patient. The supporting arms may take the form of legs holding the base from the floor or elongated arms provided with terminal clamps for engaging a fixture or both.

A preferred actuator proper includes an elongated base with a carriage having wheels running along the base through a linear path in either direction. Reversible motor means is provided for moving the carriage in reciprocal strokes along the base. An axle extends from one of the wheels for mounting an actuating member for angular movement as the axle is rotated by the wheel. Measuring means is provided for continuously measuring the degree of rotation of the wheel. And, motor control means is responsive to the measuring means for reversing the motor when the wheel reaches a given angle of rotation denoting each end of the stroke. More specifically, in the preferred construction, the elongated base is desirably provided with a shallow upwardly extending wall at its proximal end and a higher wall at its distal end. A drive screw extends from one wall to the other. Guide rails extend from the proximal end to the distal end at an upward slope. A carriage having wheels mounted on transverse axles is carried by said rails and is operatively related to the drive screw through a drive nut. A reversible motor drives the shaft in either direction. A potentiometer is mounted on one of the axles to measure its degree of rotation as the carriage is moved relative to the base. The motor control is governed by the potentiometer so that the motor means is reversed when the arm reaches a predetermined angle at either end of the stroke.

The invention also provides a preferred form of connector for adjusting the elevation and angle of the base to the floor. It includes an elongated arm having a proximal end for connection to the apparatus and a distal end for clamping to a fixture. The arm is provided close to the proximal end with a groove. A pair of opposing calipers, each have an inwardly extending base flange engaging in said groove and cheeks extending upward from the flange to a cupped proximal part. An adjusting nut has a projecting part engaging in an opening in the end of the rod. A bolt having an elongated threaded shaft extends through aligned openings in the respective cheeks and a threaded opening in the nut. A head is provided at one end of the bolt and a tightening nut on the other. Spring means extends between the respective calipers urging their terminal ends towards each other. In this way, the adjusting nut is movable along the bolt for inward adjustment of either cheek relative to the other while the tightening nut is movable along the bolt to draw the cheeks together in clamping relation to an intervening object, for example, the leg of a table, chair or cabinet. Desirably, the arm has a distal part offset from the proximal part to improve its reach.

BRIEF DESCRIPTION OF THE DRAWINGS

The invention has been generally described and it will now be referred to in more detail by reference to the accompanying drawings, illustrating a preferred embodiment and in which:

FIGS. 9 and 10 show the mobilization of the hip and knee joints, while FIGS. 11 and 12 show the mobilization of the ankle only;

DESCRIPTION OF THE PREFERRED EMBODIMENTS

General Arrangement

Figure 1:
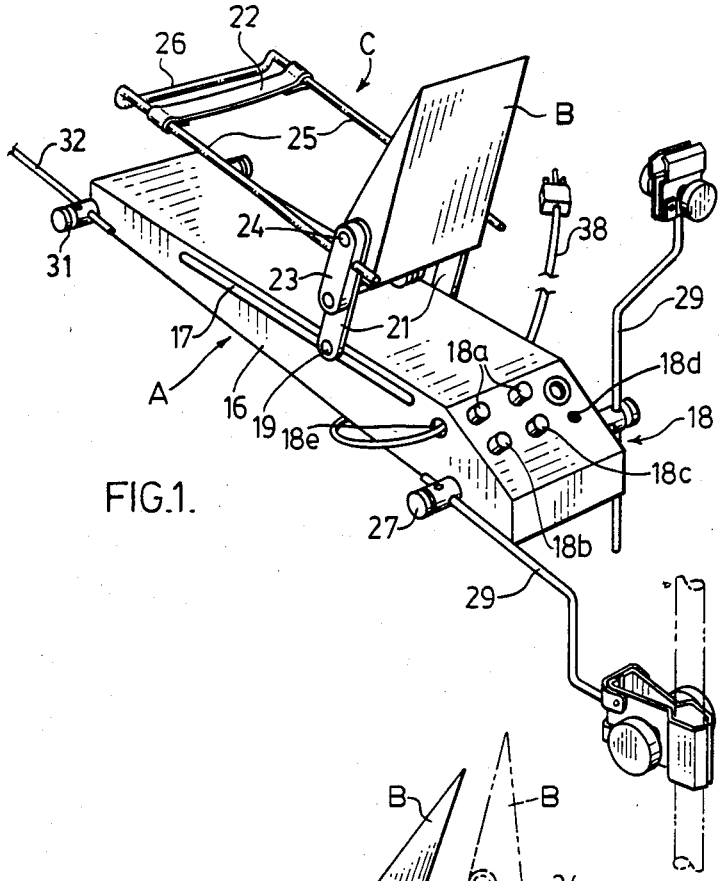
FIG. 1 is a perspective view of an apparatus according to the invention.
Figure 2:
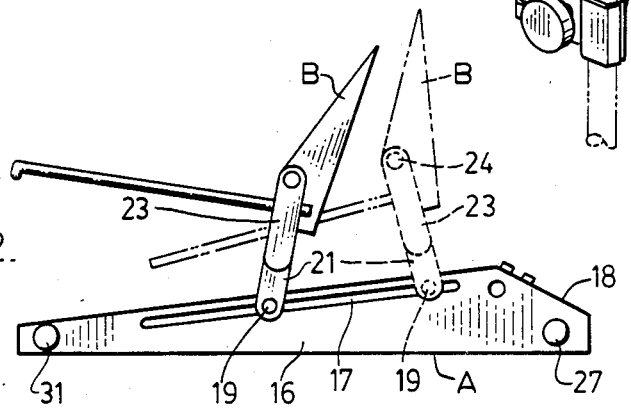
FIGS. 2 and 3 are fragmentary side elevations of the apparatus shown in FIG. 1, illustrating that the motion imparted to the limb is independent of the position of the patient.
Figure 3:
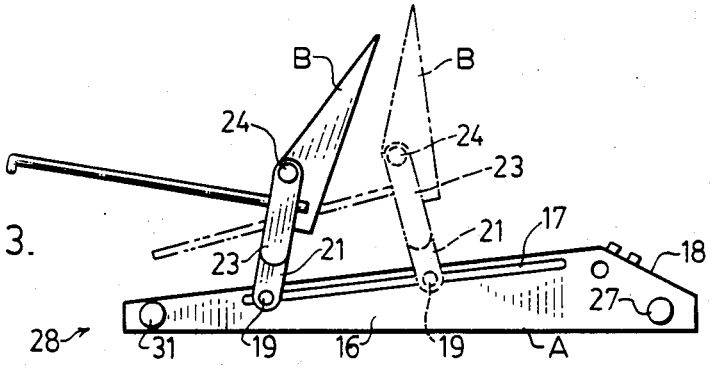
Figure 4:
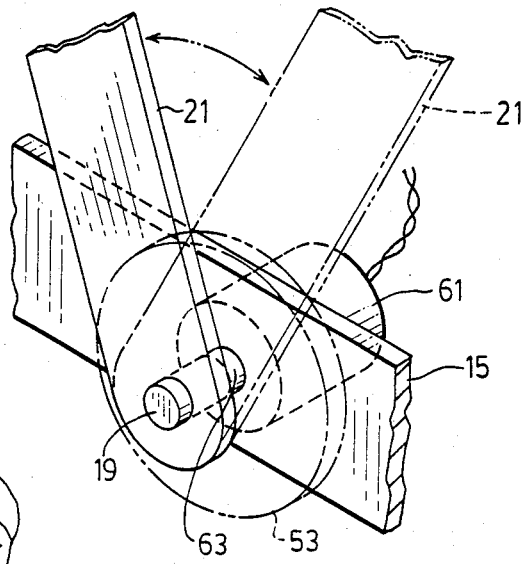
FIG. 4 is a greatly enlarged fragmentary perspective view showing the connection between the foot plate actuating arm and linear actuator and showing the potentiometer which monitors the angular position of the actuating arm.

Referring more particularly to the drawings, A is an elongated housing, which contains the linear actuator and frame or base and its support carriage, as well as a control box. The housing has opposed sidewalls 16 of the shape shown, each tapering from a relatively high distal end to a relatively low proximal end. Each sidewall has an elongated slot 17 which slopes upward from the proximal to the distal end. The shape of the housing and disposition of the slot are dictated by the desired action on the limb and for maintaining a low profile at the proximal end.

Fixedly mounted by a pin 19 on the end of a connecting rod assembly, which extends through the slot 17, is an upwardly extending actuating arm 21, rigidly attached to a foot plate B having a base for receiving the sole of the patient's foot and which is positioned to move through a vertical plane, several degrees in each direction.

At the distal end of the housing there is an inclined control panel 18. The panel 18 has angle-limiting controls **18*a*, a speed control 18*b*, a load control 18*c*, and an on-off switch 18*d*. An electrical inlet 18*e* is provided in the wall 16 to receive a plug from the electrical supply line 39**.

Figure 5:
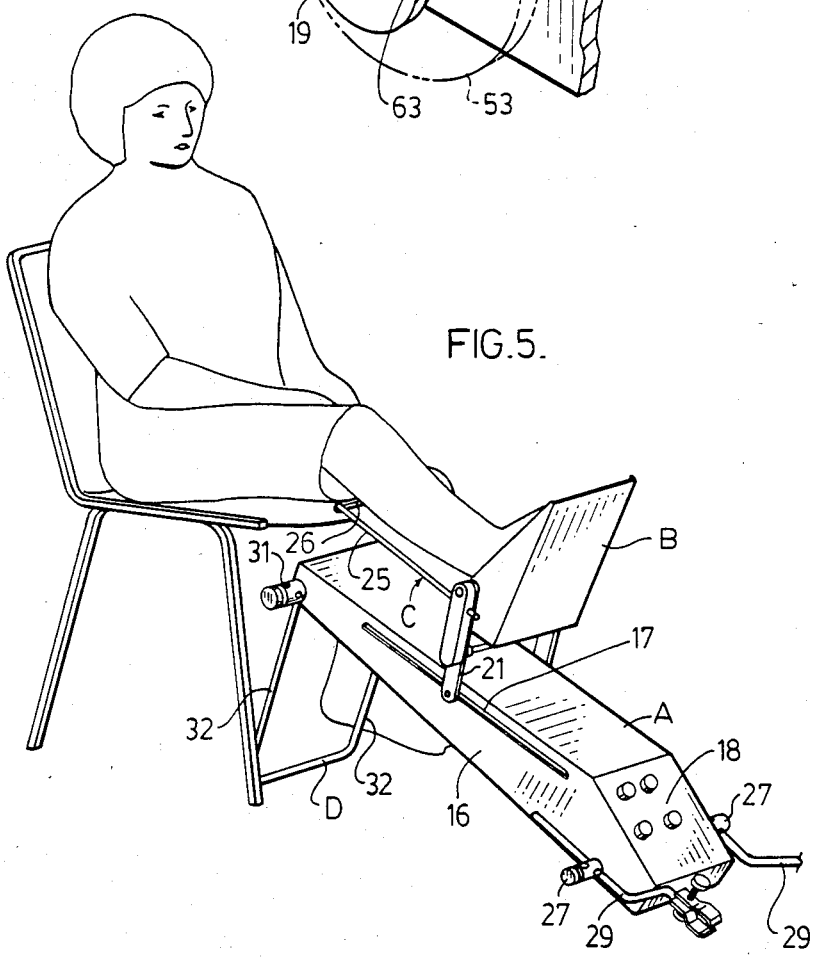
FIG. 5 shows the machine in use with the patient seated on an adjacent chair near the proximal end of the apparatus with the leg outstretched and the foot retained in the foot rest.

At the proximal end of each slot 17, there is a post 31 extending from each wall 16 and at the distal end an identical post 27. The posts 31 each receive the leg 32 of a U-shaped frame D for supporting the proximal end of the apparatus (see FIG. 5) in an elevated position or for adjusting its height to assume a lower position. All the posts 27 and 31 are interchangeable and can receive either the arms 32 of a frame D, as shown in FIG. 1, or the rods 29 forming legs of a clamping arrangement, as will be described.

Linear Actuator

Figure 6:
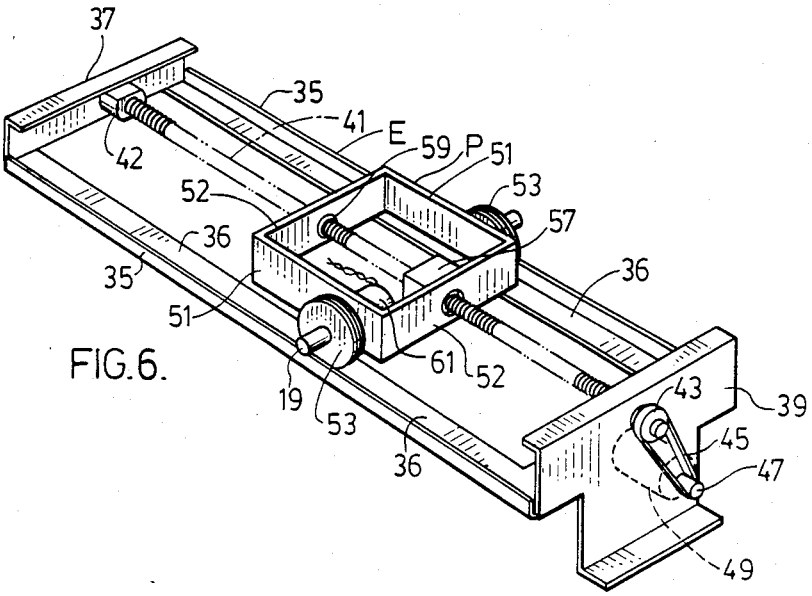
FIG. 6 is a fragmentary perspective view of the apparatus, with the casing removed, to show the linear actuator.

FIG. 6 illustrates a linear actuator, mounted within the casing A. It is made up of a support frame E, having at each side, a guide flange 35 and a sloping floor flange 36, connected at one end to a shallow proximal end plate 37 and at the other to a deeper distal end plate 39 which carry the housing A.

Between the two end plates 37, 39 there extends a drive screw 41 supported on the proximal end plate by a bushing 42 and extending through a bearing in the distal end plate 39. The screw 41 carries on the distal end a drive pulley 43, connected by a friction drive belt 45 to a shaft 47 driven by a reversible motor 49. The screw 41 slopes downwardly, relative to the frame E from the distal end to the proximal end.

A rectangular carriage P, having lateral walls 51 and endwalls 52 is supported by guide wheels 53, which ride on the sloping floor flanges 36 just inside the flanges 35. The carriage P has a drive nut 57 in one wall, through which the screw 41 engagably extends, and a bushing 59 on the opposite wall surrounding the screw 41. As the screw 41 rotates, the carriage P is moved longitudinally of the frame E, at a slight angle thereto, in one direction or the other, depending on the direction of rotation, as imparted by the reversible motor.

Figure 8:
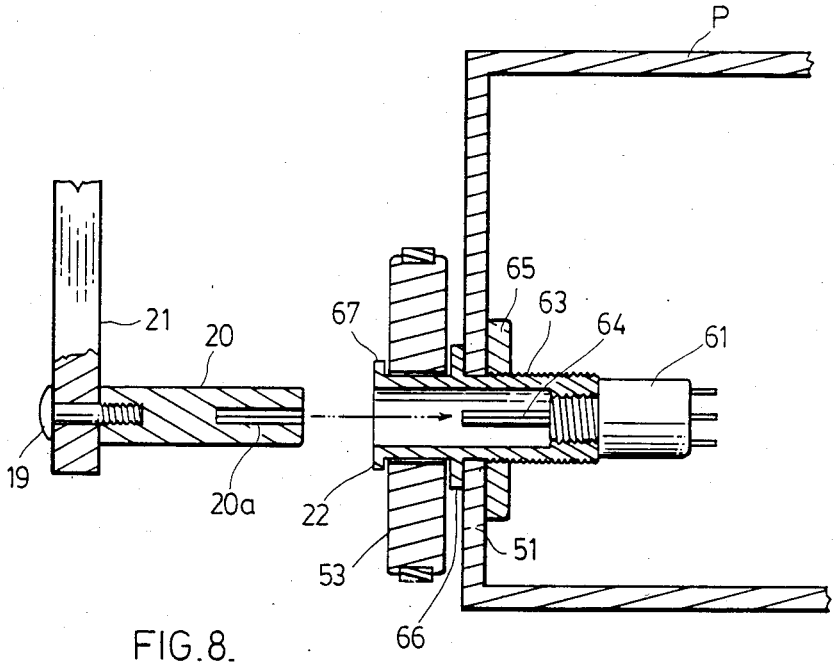
FIG. 8 (appearing on the same sheet as FIG. 6) is a greatly enlarged exploded fragmentary view on an enlarged scale showing the operative connection of the potentiometer to the foot plate assembly.

A potentiometer 61 is mounted, as best shown in FIG. 8, on an externally threaded support bushing 63 which is bolted rigidly to and extends through the wall 51 of the carriage P, a nut 65 holding it against the inner side of the wall. The bushing 63 has a shoulder 66 which bears on the outer side of the wall 51 to coact with the nut 65 and, at the same time, to provide a bearing for the wheel 53 which is held for free rotation on the bushing 63 by a retaining spring washer 67. The potentiometer 61 is screwed on to the tapped inner end of the bushing 63, with its shaft 64 protruding into the bore of bushing 63. A drive shaft 20, rigidly attached to the foot plate actuating arm 21, by the bolt 19 is inserted into the bushing and a bore 20*a* in the shaft 20 receives and is locked to the potentiometer shaft 64 against rotation relative thereto.

Foot Plate Assembly

Figure 7:
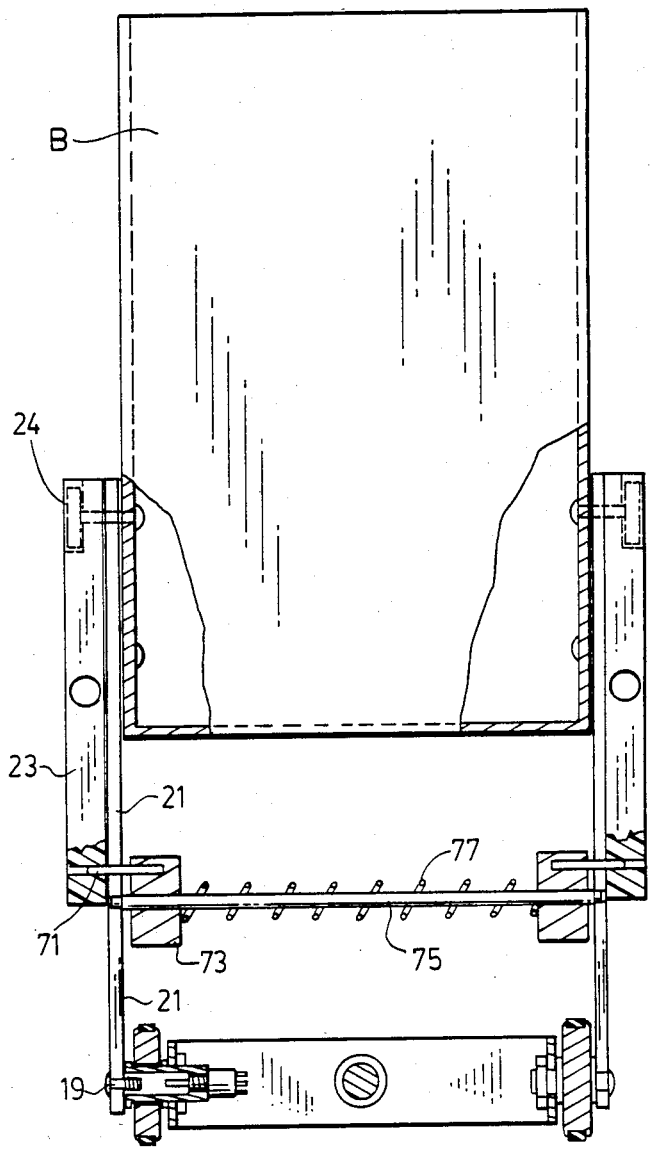
FIG. 7 is a greatly enlarged fragmentary top plan view of the foot plate assembly, its connection to the linear actuator, and showing the latch means permitting changeover from mobilizing the hip and knee to mobilizing the ankle.

The foot plate assembly (for detail see FIG. 7) is made up of the actuating arms 21 with the foot plate B itself rigidly mounted to and between the arms 21. A rotatable control beam 23 is pivotally mounted to the top of each arm 21 by a pivot 24. The beam 23 is locked to the arm 21 with a latch arrangement (see FIG. 7) including a pin 71, which protrudes from the latch block 73 through a hole in the beam 21 into a hole in the arm 23. The block 73 is slidably mounted on the shaft 75 which extends from one arm 21 to the other, and is urged into locked position by a spring 77. There is a latch block 73 on each end of the rod 75.

A supporting frame C is provided having side bars 25 held in openings in the beam 23 which extend perpendicularly from the beam 23 in the proximal direction to join a crossbar 26 at the proximal end. A sling 22 extends between the bars 25 in front of the bar 26.

When the latch block 73 is in the outer position, with its pin 71 in the hole in the arm 73 the beam 23 is locked to the arm 21 and the arm 21 and beam 23 move as one about the pivotal connection 19.

Figure 11:
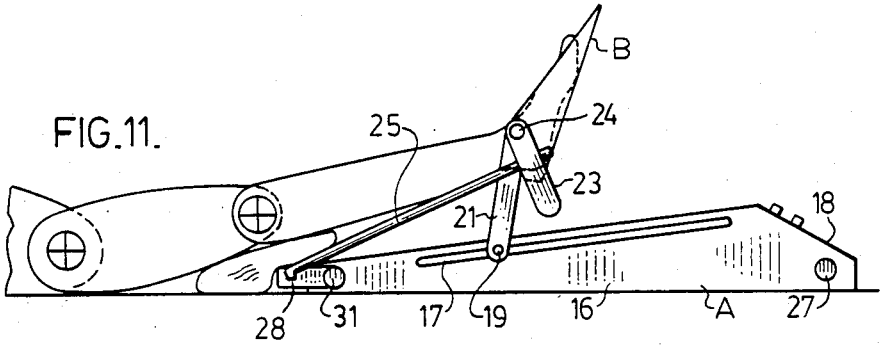
Figure 12:
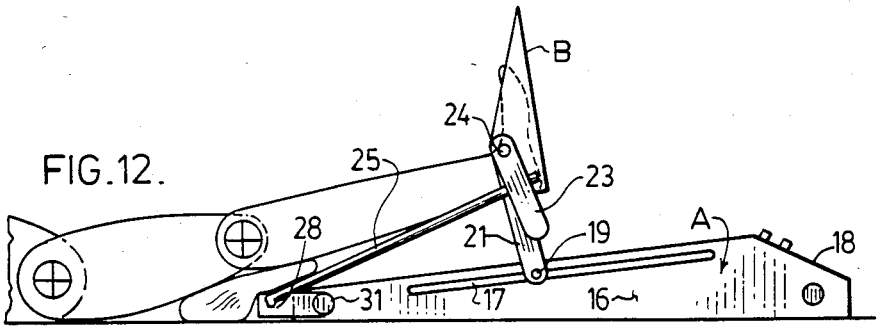
Figure 13:
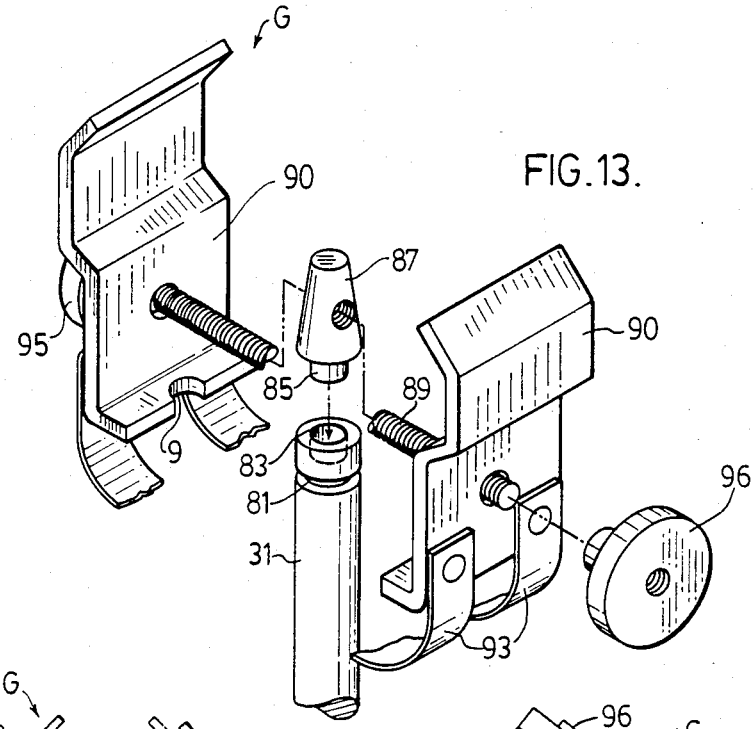
FIG. 13 is an exploded view, on an enlarged scale, showing the various parts making up the leg and clamp assembly for holding the machine to a bed or other rigid framework.

To set the apparatus for mobilizing the ankle only, the latch arrangement is released by moving the blocks 73 inward and spacing means is provided for retaining the foot rest a given distance from the proximal end. The spacing means is a frame made up of parallel bars 25 each held at one end to a control beam 23 terminating in a common crossbar 26. The crossbar 26 of the frame C is inserted into a retaining bracket 28 at the proximal end of the housing. The beam 23 is thus held in fixed position with the top of the actuating arm 21 able to pivot about the pivotal connection 24. With this setting, the movement of the linear actuator causes only movement of the ankle and not of the knee and hip. This is shown in FIGS. 11 and 12.

Operation—Knee and Hip

Figure 9:
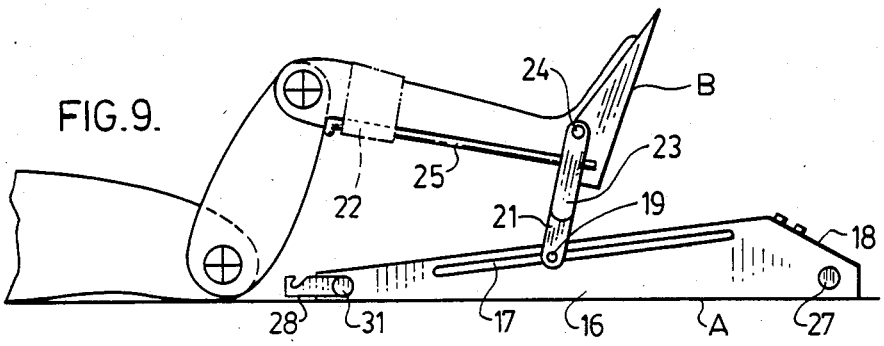
FIGS. 9 through 12 are diagrammatic side elevations illustrating the motion of the limb as it is being mobilized by the machine.
Figure 10:
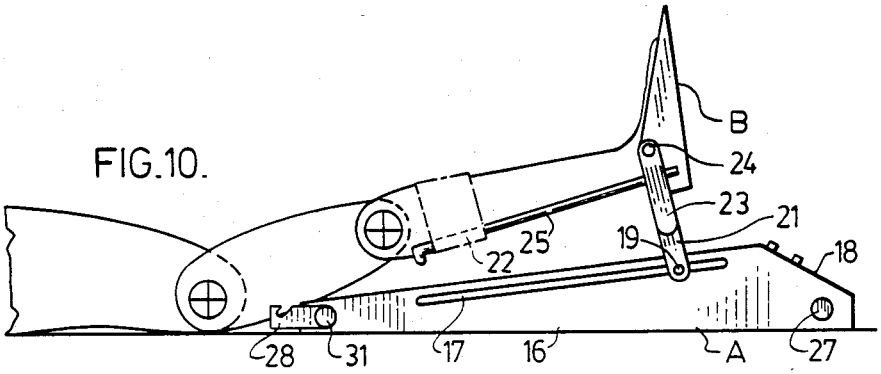

With the foot placed with its sole flat against the foot rest B, with the beam 23 latched to the arm 21, a pivotal linkage is created, including the hip joint and the knee joint and the pivotal connection of the arm 21 at 19, with the ankle joint immobile as shown in FIGS. 9 and 10. The frame C, extending from the beam 23, supports the leg just below the knee through the sling 22 extending between the bars 25.

The carriage P is capable of moving in either direction, through an elongated linear path between the distal end and the proximal end of the support frame E, i.e. the pin 19 can travel from one end of the slot 17 to the other.

The linear movement of the carriage P causes a corresponding linear movement of the bottom of the arm 21. Because of the connection of the top of the arm 21 with the patient's foot through the foot rest B, the linear movement produces a reaction of the upper end of the arm 21 which describes both a linear and an arcuate movement, as the lower end describes a linear movement, the foot rest actually following the path the leg wants to follow.

The angular movement of the arm 21 is measured by the potentiometer 61, connected, as described, to the shaft 20 held by the pin 19 to the bottom of the arm 21. The length of the stroke is controlled by setting the motor control to reverse, when the arm 21 has passed through a given angle in either direction. Considering a line through the pivotal point 19, perpendicular to the longitudinal path of the carriage, as zero, the arm 21 can go either 45° to either side of the perpendicular. For mobilizing the hip and knee, the arm 21 would pivot from about −10° to +45°. When the arm 21 reaches the far right hand side of the slot it will be about −10°. When the arm 21 reaches the proximal end of the slot, it will be about +45° or slightly more.

Control of Stroke

The potentiometer 61 continuously measures the angle of the arm 21 and consequently of the foot plate B. The range of motion (stroke) and control of the machine, is dictated by the angular limits of the movement of the shaft 20 about the point 19, as described. This is dialed on the control panel. The potentiometer measures the angle, and when the limit is reached, at either end of the range, it reverses the reversible DC motor. The DC motor can be fed by house current through a transformer, which can either be located within the apparatus or externally.

Because the range of linear motion of the foot plate is controlled by the movement of the foot plate actuating arm 21 through an angular range determined by the potentiometer, it is independent, within limits, of the linear position of the patient relative to the machine.

As far as exercising the hip and knee joints is concerned, if the patient moves closer or further away from the apparatus, the foot plate will follow the patient, but will maintain the same range of motion irrespective of the precise placement of the patient relative to the apparatus.

Clamping Arrangement

The arrangement for clamping the device to a framework, for example, that of a bed, is best shown in FIGS. 13 through 16.

A clamp support bar 29 extends from the post 27, to which it is held with a lock nut. The other end of the clamp support bar 29 receives a clamp assembly G. To this end, the end of the bar 29 is provided with a radial groove 81 and with an axial cylindrical boring 83, which slidably receives the cylindrical nipple 85 of a nut 87 of the shape shown. The nut 87 is held, as a follower, on a threaded rod 89, which extends through openings in spaced-apart calipers 90 of the stepped shape shown. The bottom ends of the calipers 90 are each provided with an inwardly extending flange having a semi-circular cut-out 91 for engaging in the groove 81. The bottom ends of the respective calipers are connected by leaf springs 93 which urge the upper parts of the calipers outwards. One end of the threaded rod 89 is rigidly attached to a knob 95. The rod 89 extends through the bore of the nut 87, then through the other caliper 90 where its threaded end receives an adjusting knob 96.

Figure 14:
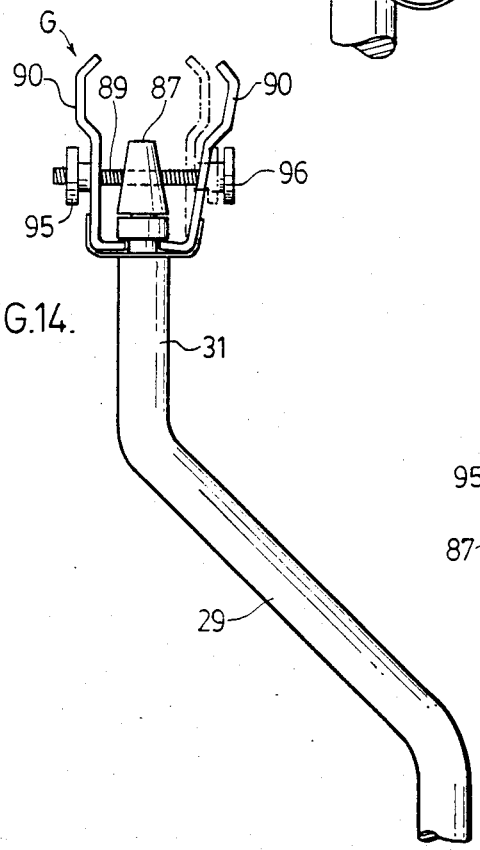
FIG. 14 is a front elevation, on a reduced scale compared to FIG. 13, showing the clamp, illustrating particularly the independent movement of each of the calipers.
Figure 15:
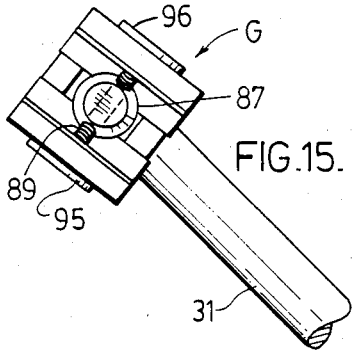
FIGS. 15 and 16 are end-on views of the leg and clamp assembly, showing the ability to rotate the clamp proper about the clamp post axis.
Figure 16:
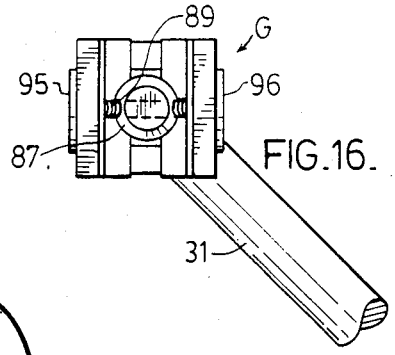

FIG. 14 shows the clamp assembly G with the upper parts of the calipers urged apart by the spring 93. The respective calipers 90 may be independently moved relative to the nut 89. The whole clamp assembly G is free to rotate on the end of the bar 29 when it is not clamped to an object. When it is clamped, e.g. a bedpost gripped between the calipers 90, there is a jamming action of the lower end of the calipers against the faces of the groove 81 locking the assembly G from rotation.

The assembly G is carried on a portion 31 of the rod 29 offset by an intermediate part. This allows the rod 29, when it rotates about its axis, to give the clamp G a greater clamping range, allowing it, for example, to be fastened onto a post anywhere within a foot of the machine.

In the particular form shown, the housing is about 2½ feet long and 6 inches wide, with the other dimensions on FIG. 1 proportionate.

I claim:

1. An apparatus for imparting continuous passive motion to joints of the leg, including an elongated base having a distal end and a proximal end from which a reclining patient's leg is extended to an elevated connection of the foot with a foot rest for receiving the sole of the foot and retaining the foot unweighted with the toes up and heel down, in which, the foot rest being fixedly connected to a first member which has a lower pivotal connection to travelling means movable relative to the base forming a linkage with the unweighted ankle, knee and hip joints, and an upper pivotal connection axially aligned with the lower pivotal connection to a second member which, in one mode, is fixed relative to the first member and, in another mode, is pivotal relative to the first member, means for latching the first member to the second member whereby they must move, in one mode, as a unit about the lower pivotal connection only, a spacing member for retaining the foot rest substantially a given distance from the proximal end, whereby the leg is held extended, when the second member is free to move relative to the first member in said other mode, motor means for imparting reciprocal linear movement to the travelling means whereby, when the spacing member is operative to keep the leg extended, the foot rest pivots back and forth in said other mode about the upper pivotal connection to mobilize only the ankle and, when the spacing member is inoperative, and the first and second members locked together, the foot rest pivots back and forth in said one mode about the lower pivotal connection to mobilize only the hip and knee joints, and control means for controlling the motor means to reverse the stroke at given terminal angles of the foot rest to the linear path of travel.

2. An apparatus for imparting continuous passive motion to joints of the leg, including, an elongated base having a distal end and a proximal end from which a reclining patient's leg is extended to an elevated connection of the foot with a foot rest, the foot rest being mounted on the upper end of an actuating arm whose lower end has a lower pivotal connection with a carriage movable along the base, in linear strokes, toward and from the proximal end, a control beam connected through an upper pivotal connection to the upper end of the actuating arm and provided with a proximally extending spacing and supporting frame for connection to the proximal end of the base to hold the control beam in a position spaced from the proximal end, with the actuating arm held for pivotal movement relative to the control beam, about the upper pivotal connection, whereby the ankle only is mobilized with the knee and hip joints immobile, catch means for locking the control beam against movement relative to the actuating arm whereby, with the supporting frame free of the base, the movement of the arm mobilizes the patient's hip and knee joints, with the ankle joint held immobile, a reversible motor for moving the carriage back and forth in linear strokes, measuring means connected to the motor control for measuring the angular position of the actuating arm, whereby the length of the strokes is governed by limits on the angular movement of the actuating arm independently of the position of the carriage along the base.

3. An apparatus, as defined in claim 1, in which the motor means includes a carriage for linear movement relative to the base through an elongated path, drive means for moving said carriage in a linear reciprocal movement towards and away from the proximal end, said lower pivotal connection being to axle means extending from said carriage transversely to its direction of linear movement, for linear movement therewith and rotary movement relative thereto, means for measuring the rotary movement of said axle means, control means responsive to said measuring means for controlling the extent of said linear movement to control the length of the reciprocating stroke irrespective of the linear position of the carriage on said base.

4. An apparatus, as defined in claim 2, in which there are companion actuating arms, one at each side of the base, a control beam pivotally related to each actuating arm, and a spacing frame comprising a rod extending proximally from each beam, and a crossbar between the rods at the proximal end to complete the frame.

5. An apparatus, as defined in claim 4, wherein the frame has a sling extending between its rods inside the crossbar for supporting the leg below the knee when the control beam is locked to the arm.

6. An apparatus, as defined in claim 2, in which the means for measuring the movement of the axle means is a potentiometer.

7. An apparatus, as defined in claim 2, in which the catch means includes a rod extending between the respective actuating arms, a block at each end of the rod adjacent to an actuating arm and resilient means for urging said blocks in the outward direction, a pin in each block for penetrating an opening in the adjacent actuating arm to enter an opening in its control beam so as to lock the control beam releasably against rotation relative to the actuating arm.

8. An apparatus, as defined in claim 1, wherein the base is provided at each end with connecting members for receiving supporting arms for adjusting the elevation and angle of the base relative to the patient.

9. An apparatus, as defined in claim 8, wherein at least some of the supporting arms are each provided with a terminal clamp for engaging a fixture.

10. An actuator for an apparatus for imparting continuous passive motion to a human joint comprising, an elongated base, a carriage having wheels running along said base through a linear path in either direction, reversible motor means for moving said carriage in reciprocal strokes along said base, an axle extending from one of said wheels for mounting an actuating member for angular movement as the axle is rotated by the wheel, measuring means for continuously measuring the degree of rotation of said wheel, and motor control means responsive to said measuring means for reversing the motor when the wheel reaches a given angle of rotation denoting each end of said stroke.

11. An apparatus, as defined in claim 10, in which, the elongated base has a proximal end and a distal end, an upstanding end plate at each end, a drive screw extending from one end of the plate to the other, guide rails extending from the proximal end to the distal end on an incline, a carriage having wheels mounted on transverse axles and carried by said rails and operatively related to the drive screw, a drive nut on said carriage operatively engaging said drive screw, the reversible motor means operatively connected to drive said shaft in either direction, said measuring means being a potentiometer mounted on said axle.

12. An apparatus for imparting continuous passive motion to human joints, comprising, a base, travelling means for linear movement on said base, and means for connecting said travelling means to a reclining patient's unweighted foot with leg extended, toes up and heel down, motor means for moving the travelling means in either direction on the base in a linear path, measuring means operatively connected to said travelling means including a traction wheel for linear movement therewith to measure the linear movement of the travelling means, control means for said motor means responsive to rotational movement of the traction wheel to reverse the motor means after a predetermined movement of the travelling means in either direction thereby to cause the travelling means to produce reciprocal strokes of a given length through a portion of said path irrespective of the position of the travelling means on said path.

13. An apparatus, as defined in claim 12, in which the measuring means includes a traction wheel rotatable by the movement of said travelling means so that the linear movement of the travelling means is translated into corresponding rotary movement of the traction wheel.

14. An apparatus, as defined in claim 13, in which the traction wheel is connected to a potentiometer which, in turn, is connected to the motor control means.

* * * * *